US008181429B2

(12) United States Patent
Iwashita et al.

(10) Patent No.: US 8,181,429 B2
(45) Date of Patent: May 22, 2012

(54) METHOD OF PRODUCING CONTENTS FILED IN A CONTAINER

(75) Inventors: Takeshi Iwashita, Yokohama (JP); Shigeru Sakai, Yokohama (JP); Chikako Sunohara, Yokohama (JP); Makoto Sawada, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 334 days.

(21) Appl. No.: 12/086,828

(22) PCT Filed: Dec. 21, 2005

(86) PCT No.: PCT/JP2005/023990

§ 371 (c)(1),
(2), (4) Date: Nov. 3, 2011

(87) PCT Pub. No.: WO2007/072575

PCT Pub. Date: Jun. 28, 2007

(65) Prior Publication Data

US 2010/0162662 A1 Jul. 1, 2010

(51) Int. Cl.
*B65B 55/04* (2006.01)

(52) U.S. Cl. ..... 53/426; 53/425; 53/440

(58) Field of Classification Search ..... 53/426, 53/425, 440, 442, 266.1, 473; 422/302, 26, 422/28, 38

See application file for complete search history.

(56) References Cited

U.S. PATENT DOCUMENTS 3,477,192 A * 11/1969 Brown et al. ..... 53/432
3,531,908 A * 10/1970 Tuma et al. ..... 53/426
3,891,779 A 6/1975 Robinson
5,054,265 A * 10/1991 Perigo et al. ..... 53/425
5,114,670 A * 5/1992 Duffey ..... 422/24
5,129,212 A * 7/1992 Duffey et al. ..... 53/426

(Continued)

FOREIGN PATENT DOCUMENTS

JP 01-139393 5/1989

(Continued)

OTHER PUBLICATIONS

PCT Search Report Dated Apr. 4, 2006.

*Primary Examiner* — Thanh Truong

(74) *Attorney, Agent, or Firm* — Hedman & Costigan, P.C.; James V. Costigan

(57) ABSTRACT

A method for producing contents filled in a container comprising steps of introducing a polyester container with a non-crystallized neck portion into a sterilized closed space having sterility and closed state on a commercial basis and comprising at least space in which a bottle sterilizing process is performed, space in which a filling process is performed and space in which a sealing process is performed, entire inner surface of said sterilized closed space and surface of an apparatus disposed in said sterilized closed space being sterilized by wet heating of the space using heated water and/or steam, at least the space in which the filling process is performed and the space in which the sealing process is performed being kept under a positive pressure by sterilized air; heating and sterilizing the container at least in its inner surface by wet heating using hot water and/or steam; and filling the contents in the sterilized container at a filling temperature within a temperature range from 40° C. to a temperature less than glass transition temperature which is determined by moisture content of the container and then sealing the container.

20 Claims, 8 Drawing Sheets

U.S. PATENT DOCUMENTS

| | | | | |
|---|---|---|---|---|
| 5,178,841 | A * | 1/1993 | Vokins et al. | 422/298 |
| 5,729,435 | A * | 3/1998 | Iijima et al. | 361/704 |
| 5,896,727 | A * | 4/1999 | Egli et al. | 53/426 |
| 5,896,899 | A * | 4/1999 | Schmitz | 141/92 |
| 6,457,299 | B1 * | 10/2002 | Schwenke et al. | 53/510 |
| 6,622,457 | B2 * | 9/2003 | Kurth | 53/425 |
| 7,491,371 | B2 * | 2/2009 | Moller et al. | 422/292 |
| 2001/0010145 | A1 * | 8/2001 | Tawa et al. | 53/425 |
| 2002/0083682 | A1 * | 7/2002 | Edwards et al. | 53/426 |
| 2002/0085971 | A1 * | 7/2002 | Raniwala | 422/303 |
| 2002/0159915 | A1 * | 10/2002 | Zelina et al. | 422/3 |
| 2005/0121408 | A1 * | 6/2005 | Deemer et al. | 215/381 |
| 2006/0182653 | A1 * | 8/2006 | Sizer | 422/28 |
| 2007/0125743 | A1 * | 6/2007 | Pritchett et al. | 215/379 |
| 2009/0007522 | A1 * | 1/2009 | Sakai et al. | 53/426 |

FOREIGN PATENT DOCUMENTS

| | | | |
|---|---|---|---|
| JP | 01-182226 | | 7/1989 |
| JP | 05-132041 | | 5/1993 |
| JP | 07-076324 | | 3/1995 |
| JP | 08-309841 | | 11/1996 |
| JP | 10-167202 | | 6/1998 |
| JP | 10-167226 | | 6/1998 |
| JP | 10-218128 | | 8/1998 |
| JP | 11-208624 | A | 8/1999 |
| JP | 11-278404 | | 10/1999 |
| JP | 2000-085888 | | 3/2000 |
| JP | 2001-278225 | | 10/2001 |
| JP | 2003-160123 | | 6/2003 |
| JP | 2004-269049 | A | 9/2004 |
| JP | 2004-331205 | A | 11/2004 |

* cited by examiner

METHOD OF PRODUCING CONTENTS FILED IN A CONTAINER

TECHNICAL FIELD

This invention relates to a method for producing contents filled in a container and, more particularly, to a method for producing beverage filled in a polyester bottle with a non-crystallized neck portion.

BACKGROUND ART

As a method for producing beverage filled in a PET bottle, known in the art is a method called "hot pack". As examples of the hot pack can be cited Japanese Patent Application Laid-open Publication No. 2001-278225 and Japanese Patent Application Laid-open Publication No. Hei 8-309841.

According to this method, acidic drink (pH less than 4.6) which has been heated to 85-95° C. or low-acidic beverage (pH 4.6 or over) is filled in a PET bottle whose heat resistance property has been improved by crystallizing its neck portion and, after sealing the bottle, the bottle is laid down to cause contents of the bottle to contact the neck portion and the cap portion of the bottle to thereby sterilize these portions and then the bottle is cooled in a cooling pasteurizer to provide a drink product.

Since, as described above, in the method for producing beverage filled in a PET bottle, contents liquid is generally filled in a PET bottle at a high filling temperature of 85-95° C., a PET bottle with a crystallized neck portion which has sufficient heat resistance at this filling temperature must be used and a PET bottle which is not crystallized in its neck portion cannot be used. Since the cost of the PET bottle with a crystallized neck portion is higher than the PET bottle with a non-crystallized neck portion, acidic and low-acidic beverages filled in a PET bottle by hot pack have the disadvantage that manufacturing cost of such beverages is high.

Moreover, hot pack requires a process for laying down a bottle after sealing it for sterilizing its neck and cap portions and this process takes extra time and, further it requires cooling time for the hot bottle to be cooled off during cooling by a cooling pasteurizer with the result that production efficiency is deteriorated.

Further, in beverage filled in a container such as beverage filled in a PET bottle in which contents can be seen from outside, reduction in the capacity of the contents can be recognized by the liquid surface level and, therefore, completeness of sealing can be recognized by observing the liquid surface level of the product after sealing. Since when a head space portion of a product is large, it will give the consumer an impression that quantity of drink is rather small, there is a demand on the side of a manufacturer that the liquid surface level of a drink should be raised to the maximum extent possible. Since, however, hot pack requires a high filling temperature, the liquid surface level after sealing drops substantially with resulting enlargement in the head space and this tends to give the impression that quantity of the drink is small.

The invention has been made in view of such disadvantages of the prior art high temperature filling method in a drink filled in a PET bottle. It is a first object of the invention to provide a method for production according to which contents filled in a container can be produced without using a polyester container with a crystallized neck portion such as a PET bottle with a crystallized neck portion.

A second object of the invention is to provide a method for producing contents filled in a container such as beverage filled in a bottle which does not require such time in laying down a container and cooling the container as in hot pack whereby production efficiency can be improved.

A third object of the invention is to provide a method for producing contents filled in a container according to which completeness of seal of a container can be recognized by observing the liquid surface level of the product while substantial drop in the liquid surface can be prevented.

Studies and experiments made by the inventors of the present invention for achieving these objects of the invention have resulted in the finding, which has led to the present invention, that, by introducing a polyester container with a non-crystallized neck portion into a sterilized closed space, sterilizing at least the inner surface of the container by wet heating using heated water and/or steam and then filling contents in the sterilized container at a filling temperature within a range from 40° C. to a temperature less than glass transition temperature which is determined by moisture content of the container and then sealing the container, sufficient sterility on a commercial basis can be secured even at a temperature within a range which is below the filling temperature of 85-95° C. according to the prior art hot pack method.

A method of producing contents filled in a container achieving the above described objects of the invention comprises steps of introducing a polyester container with a non-crystallized neck portion into a sterilized closed space in which entire inner surface of the sterilized closed space and surface of an apparatus disposed in the sterilized closed space are sterilized by wet heating of the space using heated water and/or steam and which is kept under a positive pressure by sterilized air; heating and sterilizing the container at least in its inner surface by wet heating using hot water and/or steam; and filling the contents in the sterilized container at a filling temperature within a temperature range from 40° C. to a temperature less than glass transition temperature which is determined by moisture content of the container and then sealing the container.

According to the invention; by heating and sterilizing the container at least in its inner surface by wet heating using hot water and/or steam and thereafter filling the contents in the sterilized container at a filling temperature within a temperature range from 40° C. to a temperature less than glass transition temperature which is determined by moisture content of the container, sufficient sterility on a commercial basis can be secured and, therefore, it becomes possible to use a polyester container with a non-crystallized neck portion. Further, since the filling temperature is substantially lower than that in the prior art hot pack, time required for cooling after sterilization can be shortened and, as a result, production efficiency can be greatly improved. Further, since the neck portion and the cap portion of the container can be sterilized by the wet heating of the container, the process of laying down the container after filling contents and sealing the container for sterilizing the neck portion and the cap portion of the container can be obviated and, as a result, production efficiency can be further improved. Furthermore, since the filling temperature is substantially lower than in hot pack, reduction in the capacity of the contents after cooling of the container is small and the liquid surface level can be raised as compared with a product by hot pack and this gives satisfaction to the consumer and completeness of seal of the container can be recognized.

Further, according to the invention, since in the space comprising at least space in which a bottle sterilizing process is performed, space in which a filling process is performed and space in which a sealing process is performed, entire inner surface of the space and surface of an apparatus disposed in the space are sterilized by wet heating of the space using heated water and/or steam, and at least the space in which the filling process is performed and the space in which the sealing process is performed are kept under a positive pressure by sterilized air, a rinsing process and a rinsing equipment after sterilizing the space which are required in the prior art method of spraying a sterilizer become unnecessary and, therefore, cost for such equipment can be obviated while a sterilized environment which is equivalent to the prior art one can be maintained.

According to one aspect of the invention, sterilization of the surface of the apparatus in the sterilized closed space is performed by wet heating sterilization in such a manner that surface temperature of the surface to be sterilized will become 60° C. or over and less than 80° C.

According to another aspect of the invention, the container introduced into the sterilized closed space is introduced into the sterilized closed space after being subjected in the outer surface of the container to wet heating sterilization using heated water and/or steam.

According to this aspect of the invention, since the container is sterilized by wet heating in its outer surface in the outside of the sterilized closed space and then is introduced into the sterilized closed space in which at least the inner surface of the container is sterilized with hot water, the container is introduced into the sterilized closed space in a state in which mold and bacteria which are of a high contamination degree have been sterilized and, as a result, amount of mold and bacteria introduced into the sterilized closed space is greatly reduced and possibility of mold and bacteria depositing again on the container after sterilization of the inner surface thereof is reduced to the maximum extent possible whereby sterilization of the inner and outer surfaces of the container can be achieved in the most efficient manner.

According to another aspect of the invention, the process of sterilizing the outer surface of the container introduced into the sterilized closed space is performed by wet heating sterilization in such a manner that heated water and/or steam is injected from a heated water injection nozzle or a steam injection nozzle onto the container so that temperature of the outer surface of the container will become 63° C. or over and less than 80° C.

According to another aspect of the invention, the process of sterilizing the outer surface of the container introduced into the sterilized closed space is performed in an outer surface sterilizing chamber which communicates with the sterilized closed space and is provided with an entrance and an exit of the container.

According to another aspect of the invention, the outer surface sterilizing chamber is filled with steam.

According to another aspect of the invention, the process of sterilizing at least the inner surface of the container is performed by wet heating sterilization in such a manner that temperature of the inner surface of the container will become 63° C. or over and less than 80° C.

According to another aspect of the invention, the moisture content of the container is moisture content of the non-crystallized neck portion of the container.

In manufacturing, a neck portion of a polyester container such as a PET bottle which is substantially not crystallized and not drawn is a portion which has the least heat resistance in the container. It is therefore important for preventing distortion of the neck portion due to heat that filling is made at a filling temperature which will be less than glass transition temperature determined by moisture content of the neck portion of the container. The same is the case with a neck portion of a polyester container such as a PET cup made by sheet forming which is drawn but not crystallized in manufacturing thereof.

According to another aspect of the invention, the method further comprises a process of reducing moisture content of the container before filling the contents in the container.

There is correlationship as shown in FIG. 7 between the glass transition temperature of the container such as a PET bottle with a non-crystallized neck portion and the moisture content of the container and the lower the moisture content of the container, the higher the glass transition temperature of the container. Therefore, in a case where sterilization should be made at a higher temperature for achieving sufficient sterilization, there may be a need for reducing the moisture content of the container so that the glass transition temperature of the container will become as high as possible. According to this aspect of the invention, the glass transition temperature of the container can be elevated to such a level as to exceed a necessary sterilization temperature by reducing the moisture content of the container.

According to another aspect of the invention, the method further comprises a process of forming a preform of the container, a process of forming the preform to the container and a process of reducing moisture content of the preform before forming the preform to the container. By reducing the moisture content of the preform of the container, the glass transition temperature of the container can be elevated to a higher temperature than in the case of reducing the moisture content of the container only.

The process of reducing the moisture content of the container and the preform of the container can preferably be made by dehumidifying the container. More specifically, the container and the preform of the container may be dehumidified by a dehumidifier or, alternatively, the container and the preform of the container may be kept in a humidity controlled room such as a drying room.

According to another aspect of the invention, after the container is formed, the formed container is transferred directly to the process of sterilizing at least the inner surface of the container in the sterilized closed space, or the outer surface sterilizing process of the container to be introduced into the sterilized closed space. By this arrangement, time required from forming of the container to sterilization of the container can be shortened and amount of humidity which the container absorbs from the outer environment is thereby reduced and, as a result, the moisture content of the container can be maintained at a low level to that extent.

According to another aspect of the invention, after the container is formed, the formed container is transferred directly to the sterilizing process and forming of the container is performed in an outer environment controlled space. By this arrangement, sterility of the container can be further improved.

According to another aspect of the invention, the method further comprises a process of forming a preform of the container and a process of forming the preform to the container wherein the formed preform is directly transferred to the process of forming the preform to the container.

According to another aspect of the invention, forming of the preform, transferring of the preform to the container forming process and forming of the container are performed in an outer environment controlled space.

According to still another aspect of the invention, the outer environment controlled space is Class 100,000 or below.

As described above, according to the invention, after at least the inner surface of the container is sterilized by wet heating, contents are filled in the container at a filling temperature within a temperature range from 40° C. to less than glass transition temperature which is determined by moisture content of the container whereby sufficient sterility on a commercial basis can be secured and, therefore, a polyester container with a non-crystallized neck portion having glass transition temperature within this temperature range can be used. Since the filling temperature is by far lower than the filling temperature of the prior art hot pack, time required for cooling after sterilization can be shortened and, as a result, production efficiency can be improved. Further, since the neck portion and the cap portion of the container are sterilized by wet heating sterilization of the container, the process of laying down the container after filling of the contents and sealing of the container for sterilizing the neck portion and the cap portion of the container can be obviated whereby production efficiency can be further improved. Furthermore, since the filling temperature is by far lower than the filling temperature of hot pack, reduction in the capacity of the contents after cooling of the container is small and the liquid surface level can be elevated as compared with hot pack and this give satisfaction to the consumer and completeness of seal of the container can be recognized.

Further, according to the invention, since in the sterilized closed space in which at least the inner surface is sterilized with heated water, entire inner surface of the space and surface of an apparatus disposed in the space are sterilized by wet heating of the space using heated water and/or steam, and the space is kept under a positive pressure by sterilized air, a rinsing process and a rinsing equipment after sterilizing the space which are required in the prior art method of spraying a sterilizer become unnecessary and, therefore, cost for the equipment can be obviated while a sterilized environment which is equivalent to the prior art one can be maintained.

According to one aspect of the invention, since the container is sterilized by wet heating in its outer surface in the outside of the sterilized closed space and then is introduced into the sterilized closed space in which at least the inner surface of the container is sterilized with hot water, the container is introduced into the sterilized closed space in a state in which mold and bacteria which are of a high contamination degree have been sterilized and, as a result, amount of mold and bacteria introduced into the sterilized closed space is greatly reduced and possibility of mold and bacteria depositing again on the container after sterilization of the inner surface thereof is reduced to the maximum extent possible whereby sterilization of the inner and outer surfaces of the container can be achieved in the most efficient manner.

There is correlationship between the glass transition temperature of the container such as a PET bottle with a non-crystallized neck portion and the moisture content of the container and the lower the moisture content of the container, the higher the glass transition temperature of the container. Therefore, in a case where sterilization should be made at a higher temperature for achieving sufficient sterilization, there may be a need for reducing the moisture content of the container so that the glass transition temperature of the container will become as high as possible. According to one aspect of the invention, the glass transition temperature of the container can be elevated to such a level as to exceed a necessary sterilization temperature by reducing the moisture content of the container.

According to one aspect of the invention, by shortening time required from forming of the container to filling of the contents, amount of humidity which the bottle absorbs from the outer environment is reduced and the moisture content of the bottle can be maintained at a low level to that degree.

DESCRIPTION OF PREFERRED EMBODIMENTS

Figure 1:
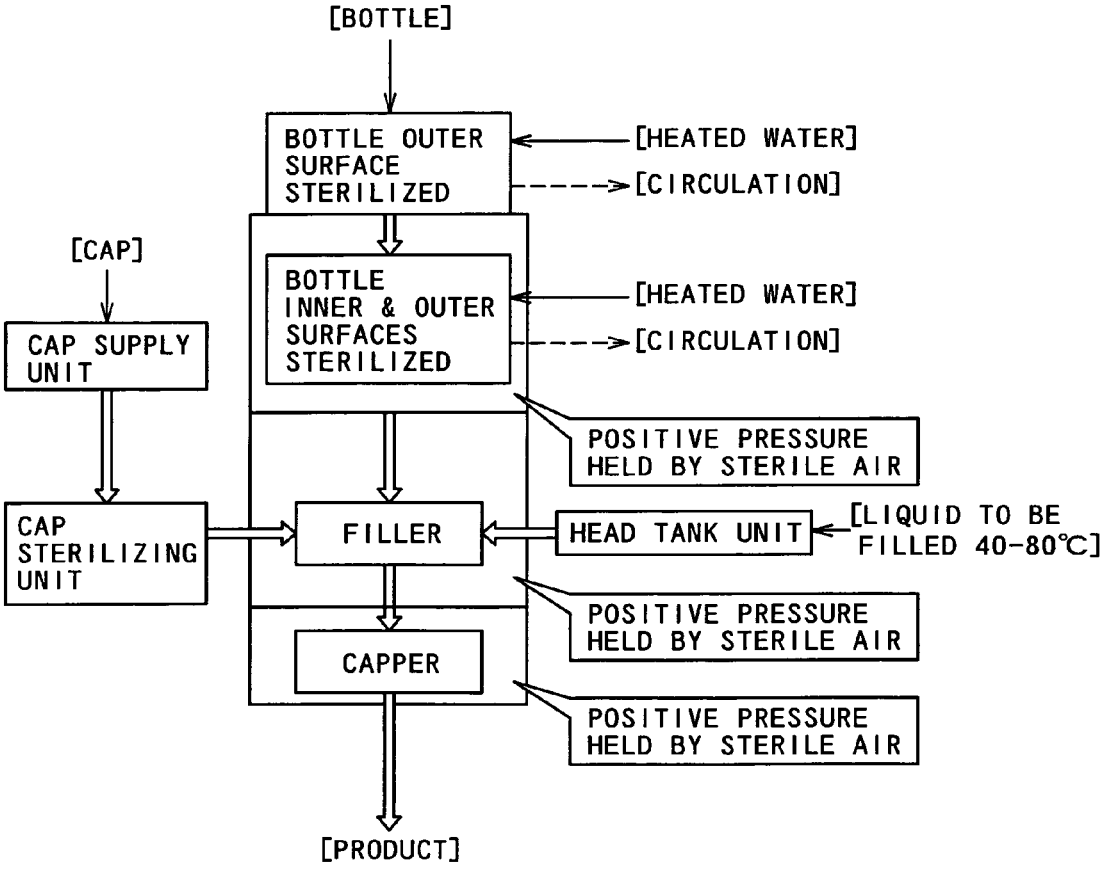
FIG. 1 is a flow chart showing an embodiment of the method of the present invention.

Embodiments of the present invention will be described with reference to the accompanying drawings.

Containers used in the method of the present invention include a polyester bottle such as a PET bottle and other polyester containers such as a cup, tray and tube made of polyester. Contents to which the method of the present invention is applied include beverages and food such as jam, seasonings such as sweet sake and sauses, cosmetics and pharmaceuticals. Beverages to which the method of the present invention can preferably be applied include acidic drinks having pH of less than 4.6, low-acidic drinks having pH of 4.6 or over and mineral water. Acidic drinks include fruit drink, vegetable drink, milk drink and black tea drink (lemon tea), acidic functional drink (sports drink) and near water. Low-acidic drinks include coffee and tea drink which do not contain milk such as sugarless coffee, coffee containing sugar, green tea, black tea, and oolong tea.

In the production method of the invention, a polyester container with a non-crystallized neck portion is inroduced into a sterilized closed space in which entire inner surface of the sterilized closed space and surface of an apparatus disposed in the sterilized closed space are sterilized by wet heating of the space using heated water and/or steam and which is kept under a positive pressure by sterilized air, the container is heated and thereby sterilized at least in its inner surface by wet heating using hot water and/or steam, and contents are filled in the sterilized container at a filling temperature within a temperature range from 40° C. to a temperature less than glass transition temperature which is determined by moisture content of the container and then the container is sealed.

As a typical example, description will now be made about case where beverage is filled in a PET bottle with a non-crystallized neck portion.

In case the method of the present invention is applied to beverage to be filled in a bottle, it is preferable that sterilization of the bottle is made in two steps of sterilization of its outer surface and sterilization of its inner surface. First, the outer surface of the bottle is sterilized by wet heating using heated water or steam in space outside of the sterilized closed space and then the bottle is introduced into the sterilized closed space where the inner surface of the bottle is sterilized by heated water. Outline of this embodiment is shown in the flow chart of FIG. 1.

Sterilization by wet heating of the outer surface of the bottle is made within a temperature between 63° C. and 80° C. In case of 63° C., sterilization time requires 8 seconds or over and more preferable sterilizing condition is 65° C. for 10 seconds. In case of 95° C., 2 seconds or over is preferable. If possible, the outer surface sterilization should preferably be made in an outer surface sterilizing chamber which communicates with the sterilized closed space and has an entrance and an exit of a container. Sterilization of the outer surface of the bottle may be made regardless of whether the bottle is in an erecting state or in an inverted state.

Figure 2:
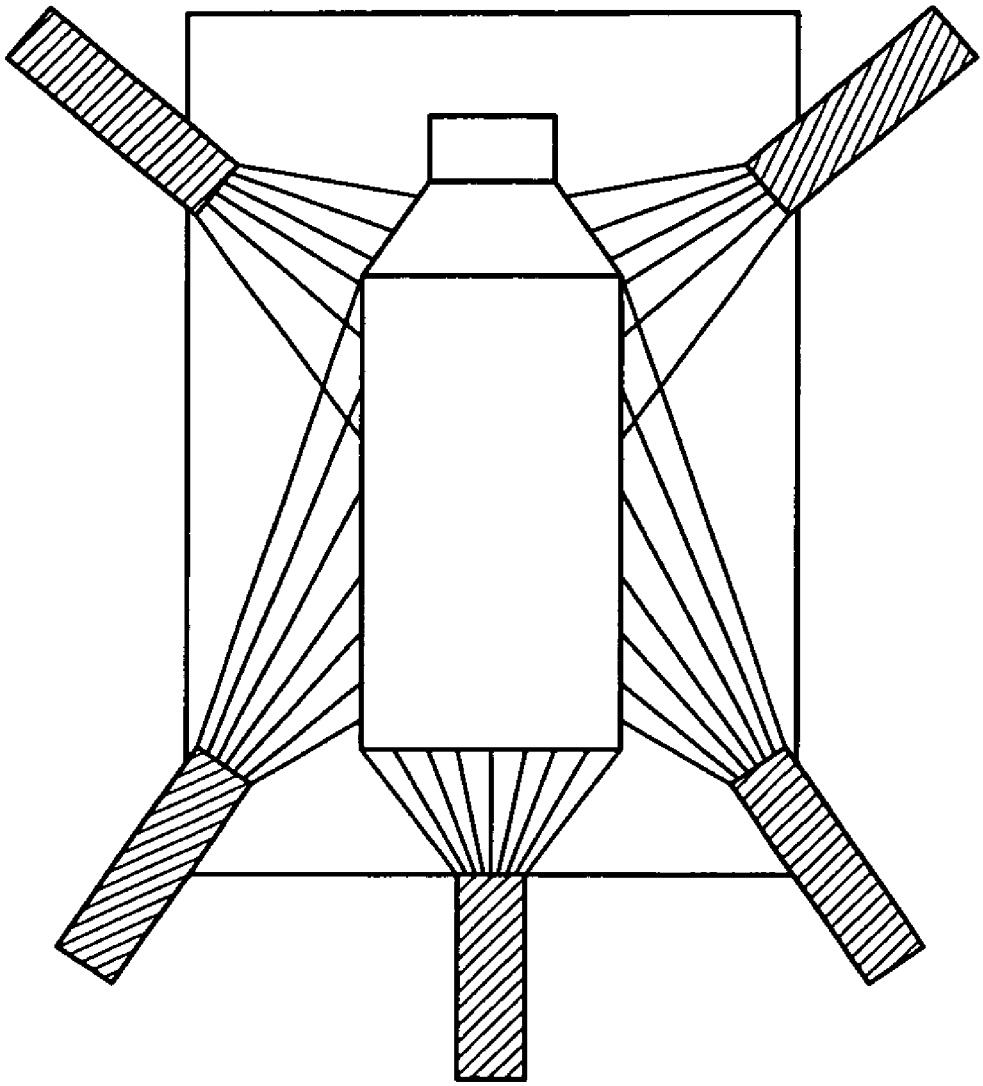
FIG. 2 is an explanatory view illustrating an example of a process of sterilizing the outer surface of a bottle by heated water.

In both cases of an erecting state and an inverted state of the bottle, sterilization of the outer surface of the bottle may be made by directing, as shown in FIG. 2, a plurality of heated water spray nozzles provided in an outer surface sterilizing chamber toward the side surface and the bottom surface of the bottle and injecting heated water to the bottle.

The outer surface sterilizing chamber in which sterilization of the outer surface of the bottle is performed should may be filled with saturated steam generated by scattering heated water or blowing in steam. By filling the inside of the outer surface sterilizing chamber with steam, the effect of sterilizing the outer surface of the bottle is improved and, simultaneously, the outer surface sterilizing chamber becomes air-sealed against atmosphere outside of the entrance for the bottle so that bacteria in atmosphere is prevented from entering the sterilized closed space.

Figure 3:
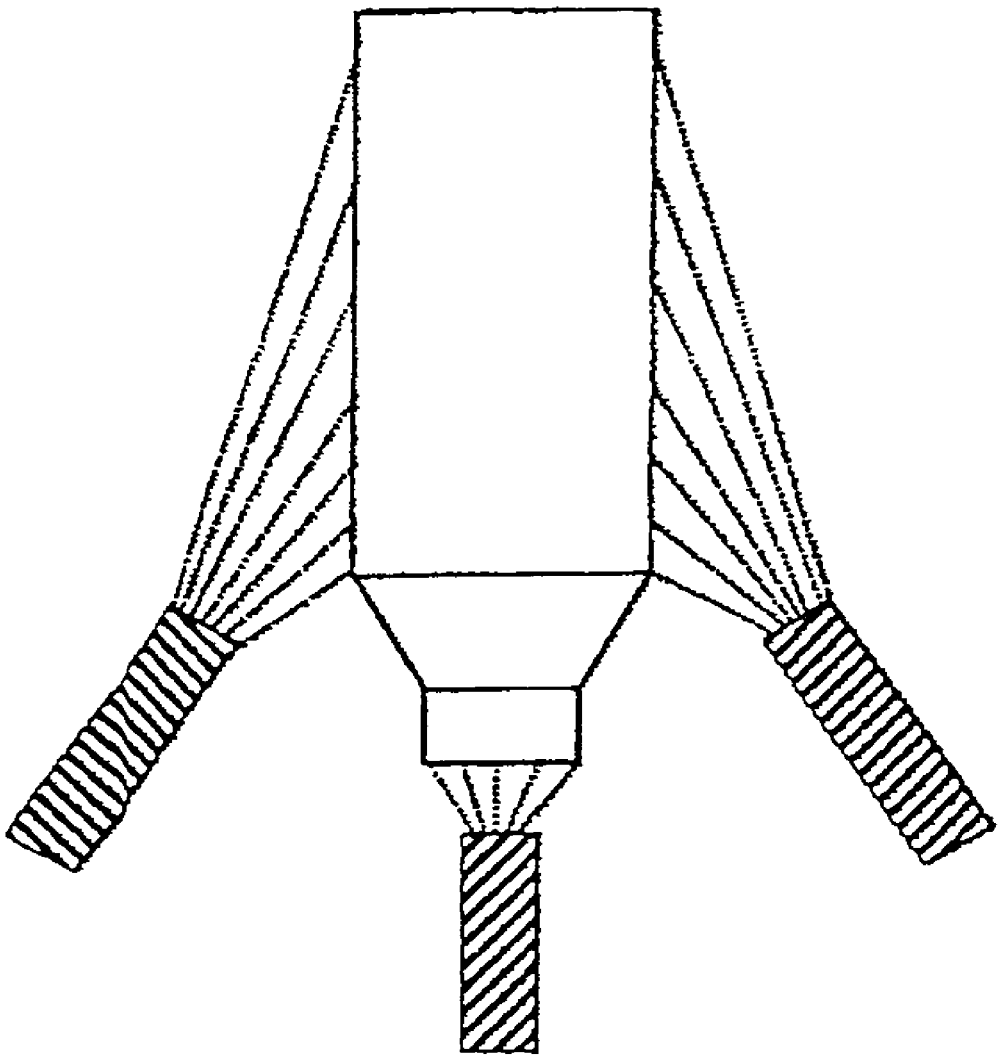
FIG. 3 is an explanatory view illustrating an example of a process of sterilizing the inner surface of a bottle by heated water.

Sterilization of the inner surface of the bottle is made in the sterilized closed space. In the sterilized closed space, as shown in FIG. 3, one heated water spray nozzle is disposed below the opening of the inverted bottle and heated water is injected toward the inside of the bottle. It is also possible to inject heated water by inserting the heated water spray nozzle into the inside of the bottle but, by injecting heated water with the heated water spray nozzle being fixedly disposed below the opening of the bottle as shown in FIG. 3, vertical movement of the heated water spray nozzle is unnecessary and, as a result, mechanical construction of the apparatus can be simplified. In the example shown in FIG. 3, not only the inner surface of the bottle, but the outer surface of the bottle is sterilized by injection of heated water.

In this specification, the sterilized closed space means sealed space formed by enclosing a part of space of a working room having an entrance and an exit for a container, said sealed space being maintained in a sterile state by introducing sterilized air under positive pressure. If wet heating sterilization is conducted in a clean room, the entire wall surface cannot be sterilized and, moreover, a HEPA filter provided in the ceiling section of the clean room is likely to be damaged by steam and, therefore, the clean room is not suitable for wet heating sterilization and subsequent filling of contents in the bottle by a filler. Further, since the clean room which requires a high installation cost and requires a complicated control can be obviated by using the sterilized closed space of the invention, cost required for sterilizing the container can be further reduced. Sterilizaion of the inner surface of the bottle by heated water in the sterilized closed space is performed also from 63° C. to 95° C. As shown in Example 1 to be described later, in case of 63° C., sterilization time of 8 seconds or over is required. A more preferable sterilizing condition is 65° C. for 10 Seconds or over. In case of 95° C., 2 seconds or over is preferable. In case of 60° C. or over, sterilization value becomes higher and 95° C. is the upper limit temperature under which injection can be made stably. Sterilization of the outer surface and the inner surface of the bottle can be made by circulating heated water of the above described temperature by a pump. Sterilization of the inner surface of the bottle should preferably be made with the bottle in an inverted state so that heated water after sterilization will be excluded from the bottle by gravity.

As to sterilization of the outer and inner surfaces of the bottle, sterilization by using water steam is as effective as sterilization by using heated water.

In a case where sterilization of the outer surface of the bottle in the outer surface sterilizing chamber, this sterilizing chamber should preferably communicate with the sterilized closed space where sterilization of the inner surface of the bottle is made. By this arrangement, deposition of bacteria from outside in the course of transfer from the outer surface sterilizing chamber to the sterilized closed space can be prevented.

After completion of sterilization of the inner surface of the bottle, the bottle is transferred to a filler in the sterilized closed space of the same condition and contents liquid held in a head tank unit is filled in the bottle. The head tank unit stores contents liquid which has been heated to a predetermined temperature within a temperature range between 40° C. to 80° C. which is less than glass transition temperature which is determined by moisture content of the bottle. Accordingly, as the bottle, one which has glass transition temperature which is below the temperature of the contents liquid to be filled is selected. Moisture content of the bottle is one important factor which determines glass transition temperature of the bottle and the smaller the moisture content of the bottle, the higher is the glass transition temperature of the bottle. Therefore, for securing sufficient glass transition temperature, the bottle is dehumidified by a dehumidifier or the like, if necessary, before the bottle is sterilized so that the moisture content of the bottle will be lowered.

If the filling temperature of the contents liquid is less than 40° C., sufficient reduction of the capacity of the contents liquid, that is, sufficient reduction in pressure of the head space, becomes difficult. On the other hand, in the present invention, a filling temperature exceeding 8.0° C. is unnecessary for sterilization of the bottle and will be mere waste of energy and, besides, if the filling temperature exceeds 80° C., it becomes difficult to secure sufficient heat resistance in the PET bottle with a non-crystallized neck portion. Therefore, the lower limit of the preferable filling temperature is 40° C., more preferably 50° C. and most preferably 60° C. and the upper limit is 80° C.

The filling temperature herein means a temperature of the neck portion of the container. The temperature of the neck portion of the container is a temperature at any selected position from the inner surface to the outer surface of the neck portion but a temperature at the outer and inner surfaces of the neck portion, particularly a temperature at the outer and inner surfaces of the neck portion which contact a sealing means is important. There is a case where a slight gap is produced between the outer and inner surfaces of the neck portion of the container and the sealing means and if sufficient sterilization is not made with liquid content remaining in this gap, bacteria may grow or mold may be developed. Therefore, it is necessary to adjust sterilization condition so that the temperature of the outer and inner surfaces of the neck portion of the container, particularly the temperature of the outer and inner surfaces of the neck portion which contact the sealing means, will become 40° C. or over.

The temperature at an intermediate portion between the outer and the inner surfaces is also important. If the temperature at this intermediate portion exceeds glass transition temperature which is determined by moisture content of the container, distortion occurs in the neck portion which leads to malfunction in sealing. It is therefore necessary to adjust sterilization condition so that the temperature at this intermediate portion will not exceed the glass transition temperature which is determined by moisture content of the container.

The bottle in which contents liquid has been filled is transferred to a capper provided in the sterilized closed space under the same condition and is sealed completely with a cap which is supplied from a cap supply unit to a cap sterilizing unit and is sterilized in a known manner. Then the bottle is transferred out of the sterilized closed space as a beverage product filled in the bottle. Then, the bottle is transferred to a cooling pasteurizer and is cooled to a room temperature and then is provided as a product.

Figure 4:
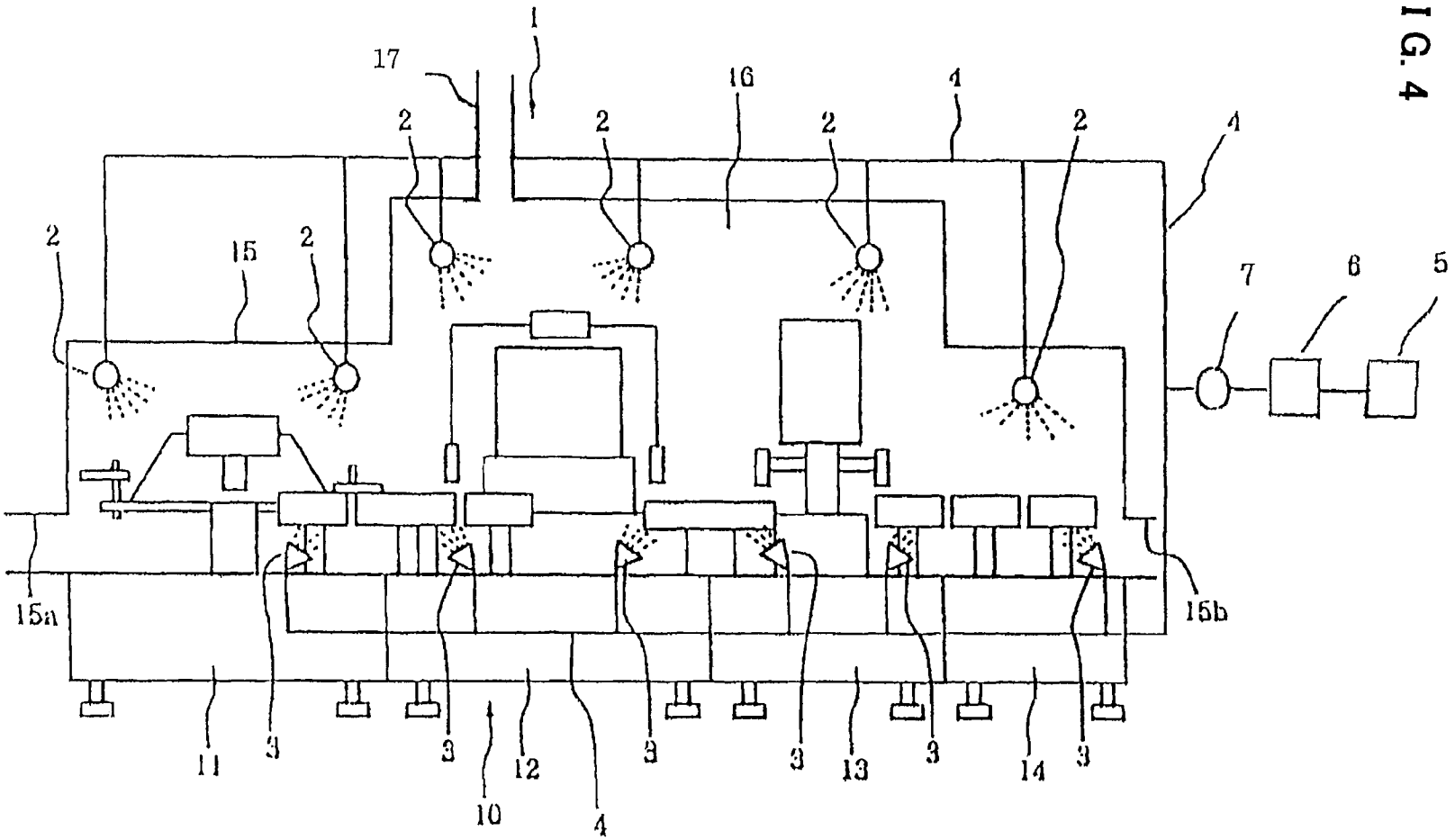
FIG. 4 is a schematic view showing an example of an apparatus for sterilizing a sterilized closed space.

FIG. 4 is a view schematically showing, as a specific example of an apparatus for carrying out sterilization of the inner surface of the bottle after sterilization of the outer surface thereof, filling of contents and capping.

In FIG. 4, a beverage filling unit 10 is a filling unit for filling a beverage in a PET bottle and, in the order of conveying direction of the bottle, there are provided a bottle rinser 11 for sterilizing an inner surface of the bottle, a filler 11, a capper 13 and a sorting unit 14 for sorting out bottles in two lines. The beverage filling apparatus 10 is covered by a cover 15 made of a steel plate and a box 16 forming the sterilized closed space is formed by this cover 15.

The inside of the sterilized closed space is filled with a sterilized air supplied from a duct 17 and kept under a positive pressure by sterilized from the duct 17.

The cover 15 is formed with a bottle inlet 15*a* and a bottle outlet 15*b* but the box 16 is substantially closed.

A sterilized closed space sterilizing unit 1 comprises a plurality of rotary nozzles 2 and a plurality of stationary nozzles 3 which constitute means for spraying heated water in the box 16. The rotary nozzles 2 consist of spray balls which are disposed in the upper portion of the box 15 with their injection openings being directed downwardly. The stationary nozzles 3 consist of full corn nozzles which are disposed in the lower portion of the box 16 in the vicinity of the floor with their injection openings being directed obliquely upwardly. The rotary nozzles 2 and the stationary nozzles 3 are connected to a heated water supply source 5 by a pipe 4 through a valve 7 and a warming heater 6 and can receive heated water from the heated water supply source 5.

In case sterilizing is made by using this apparatus, the valve 7 is operated to connect the pipe 4 to the heated water supply source 5. Water from the heated water supply source 5 is heated by the warming heater 6 and is supplied to the rotary nozzles 2 and stationary nozzles 3 through the pipe 4 and then is sprayed from these nozzles in the inside of the box. The heated water thus sprayed falls onto the most part of the surface to be sterilized including the outer surface of the bottle rinser 11, filler 12, capper 13 and sorting unit 14 in the box 16, the inner wall surface of the box 16 and a line (not shown) for supplying the heated water to the bottle rinser 11 and wet these surfaces to be sterilized. By wetting the most of the surface to be sterilized, the sprayed heated water sterilizes this part and evaporated steam is filled in the box 16 and thereby contacts the entire surface to be sterilized including a portion which is not wetted by the heated water whereby further sterilizing is performed. By continuing spraying of the heated water for a predetermined period of time, complete sterilizing of the entire surface to be sterilized is achieved. In this case, the inner wall surface of the box 16 which is the inner wall surface of the environment controlled space can be sufficiently sterilized in the same manner as the surface of the units.

Heating of the heated water is adjusted so that the sterilizing temperature will become 60° C. or over, more preferably 65° C. or over and not higher than 96° C. for performing sterilizing under the atmospheric pressure.

For sterilizing the apparatus, heating by, e.g., superheated steam at a temperature of 100° C. or over under the atmospheric pressure is also possible but, since it will require an additional equipment, sterilization by heated water of less than 96° C. will be reasonable.

Figure 5:
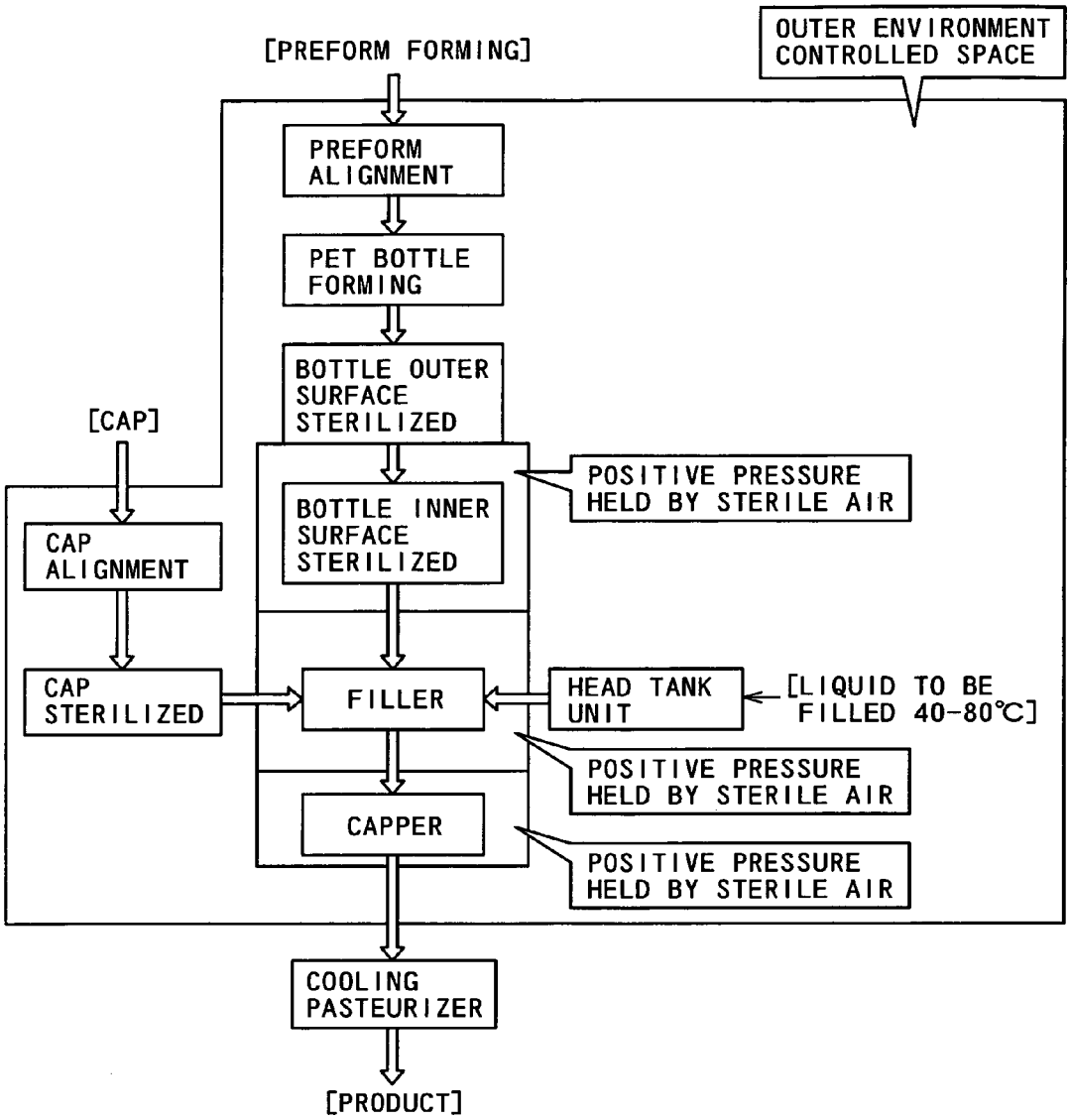
FIG. 5 is a flow chart showing another embodiment of the method of the present invention.

FIG. 5 is a flow chart showing another embodiment of the invention. In this embodiment, in a former stage of the bottle outer surface sterilizing chamber in FIG. 1, a preform alignment unit and a PET bottle forming unit are disposed in an outer environment controlled space. The outer environment controlled space herein means a working room or space defined by partitioning a part of a working room where the sterile state is controlled to a predetermined class or below. As the outer environment controlled space, space of Class 100, 000 or below is preferable. A clean room, for example, is a preferable outer environment controlled space. In the embodiment of FIG. 5, a cap alignment unit, a cap sterilizing unit and a head tank unit are also disposed in the outer environment controlled space.

Preforms of PET bottles are aligned in a line by the preform alignment unit and are transferred one by one to the PET bottle forming unit at a next stage. In the PET bottle forming unit, a preform is formed to a PET bottle with a non-crystallized neck portion and the formed PET bottle is immediately and directly transferred to the bottle outer surface sterilizing chamber. In this embodiment, the formed PET bottle is directly transferred to the bottle outer surface sterilizing chamber and, therefore, there is hardly time for the PET bottle to absorb moisture from the outer environment. By shortening time from manufacture of the bottle to filling of contents liquid in this manner, moisture content of the bottle can be held at a minimum and glass transition temperature thereby can be maintained at a desired high temperature. This embodiment, therefore, is effective when it is desired to achieve as high a temperature as possible while using a bottle with a non-crystallized neck portion.

Since processes after sterilization of the outer surface of the bottle are the same as those of the embodiment shown in FIG. 1, description thereof will be omitted.

Figure 6:
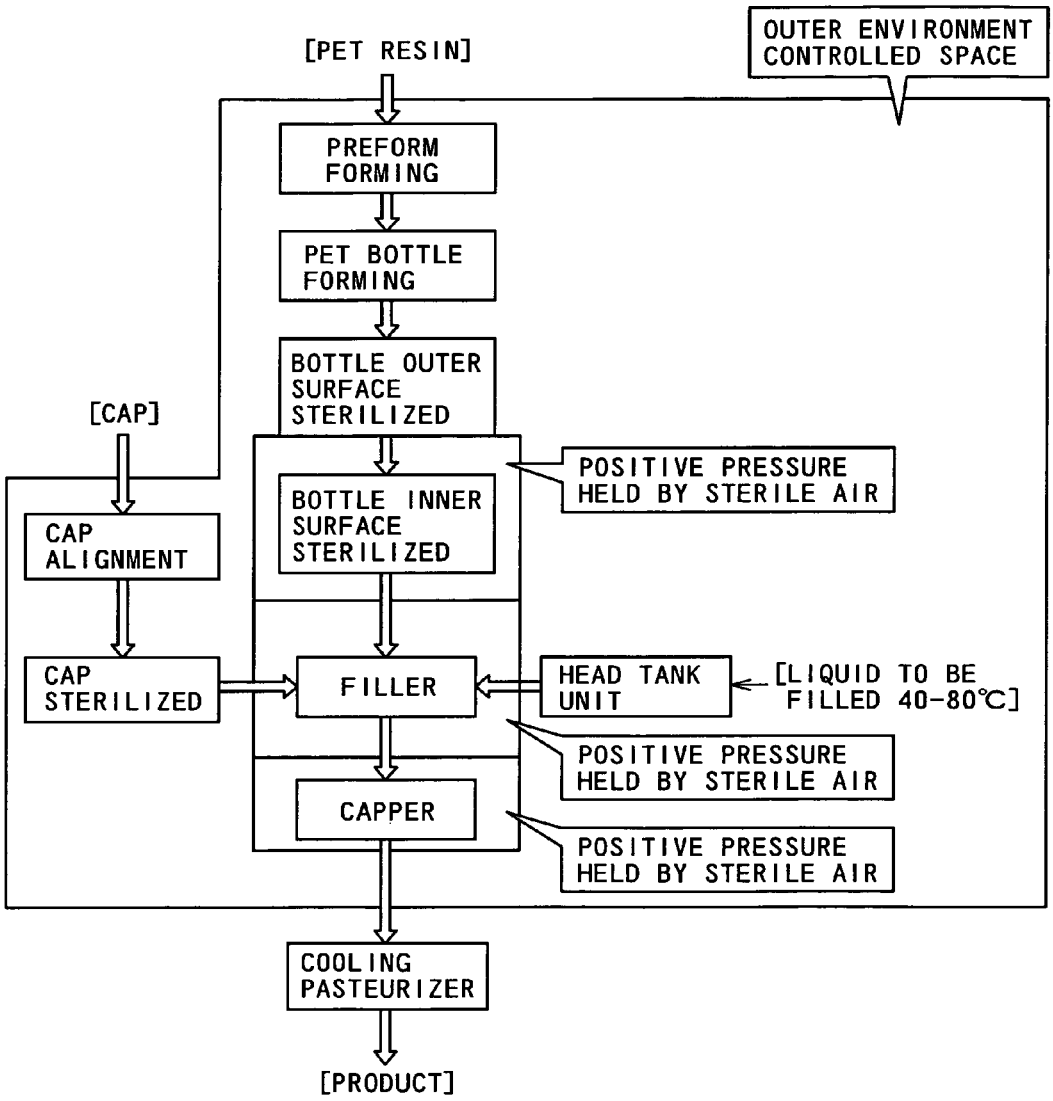
FIG. 6 is a flow chart showing another embodiment of the method of the present invention.

FIG. 6 is a flow chart showing another embodiment of the invention. In this embodiment, in a former stage of the bottle outer surface sterilizing chamber in the embodiment of FIG. 1, a preform alignment unit and a PET bottle forming unit are disposed in an outer environment controlled space. In the embodiment of FIG. 6, a cap alignment unit, a cap sterilizing unit and a head tank unit are also disposed in the outer environment controlled space.

In this embodiment, forming of a preform per se is made in the outer environment controlled space and the formed preform is transferred directly to a PET bottle forming unit and, therefore, there is hardly time for the formed preform to absorb moisture of the outer environment. Thus, time from forming of the preform to filling of contents liquid via forming of the bottle can be shortened to maximum degree whereby moisture content of the bottle can be further reduced and glass transition temperature of the bottle can be maintained at a further higher temperature below 80° C. The processes after forming of the bottle are the same as those of the embodiment shown in FIG. 5 and therefore description thereof will be omitted.

It has been found that, according to the above described embodiments, by filling contents liquid in the bottle at a filling temperature from 40° C. to 80° C., sufficient drop of the internal pressure in the head space portion of the bottle occurs due to reduction of the capacity of the contents liquid after cooling as shown in Example 5 to be described later. In a case of a drink filled in a bottle such as a drink filled in a PET bottled in which contents can be seen from outside, there is a demand on the side of manufacturers to elevate the liquid surface level of the drink to maximum extent possible, for if the head space portion is large, it will give the consumer the impression that quantity of the drink is small. It is also possible to recognize completeness of seal of the container by observing the liquid surface level of the product after sealing, for the degree of reduction in the internal pressure can be recognized by the liquid surface level. According to the embodiments of the invention, by sufficient reduction in the internal pressure in the head space portion, completeness of seal can be recognized while the liquid surface level is elevated as compared with hot pack and this will give satisfaction to the consumers.

EXAMPLES

Example 1

As a sample bottle, a PET bottle having capacity of 250 ml and a neck portion diameter of 38 mm was used.

*Aspergillus niger* ATCC6275 was cultivated on a potato dextrose agar medium for 30 days and this bacterium was used as a test bacterium.

Spore suspension of the test bacterium was sprayed by 0.1 ml over the outer surface of the sample bottle so that the suspension will be deposited on the sample bottle at the ratio of $10^6$ cfu/bottle. The bottle was dried overnight in a clean room and used as the sample bottle.

This sample bottle was sterilized by wet heating in an erecting state by the method shown in FIG. 2.

The number of surviving bacteria on the outer surface of the bottle after the sterilization was counted by cultivating for seven days at 30° C. on a potato dextrose agar medium and sterilization effect was calculated by Log(initial number of bacteria/number of surviving bacteria).

Relation between the sterilization effect and sterilizing temperature and time of the outer surface of the bottle is shown in Table 1.

TABLE 1

| Bottle outer surface temperature (° C.) | time (seconds) 3 | 5 | 8 | 10 |
|---|---|---|---|---|
| 63 | X | X | ○ | ○ |
| 65 | X | ○ | ○ | ◎ |
| 67 | ○ | ◎ | ◎ | ◎ |
| 69 | ◎ | ◎ | ◎ | ◎ |

| Sterilizing effect | | |
|---|---|---|
| | 6 D or over | ◎ |
| | 3 D or over | ○ |
| | Below 3 D | X |

Example 2

As a sample bottle, a PET bottle having a capacity of 250 ml and a neck portion diameter of 38 mm was used.

Aspergillus niger ATCC6275 was cultivated on a potato dextrose agar medium for 30 days and this bacterium was used as a test bacterium.

Spore suspension of the test bacterium was sprayed by 0.1 ml over the inner and outer surfaces of the sample bottle so that the suspension will be deposited on the sample bottle at the ratio of $10^6$ cfu/bottle. The bottle was dried overnight in a clean room and used as the sample bottle.

This sample bottle was sterilized in its inner and outer surfaces by wet heating in an erecting state by the method shown in FIG. 3.

The number of surviving bacteria on the inner and outer surfaces of the bottle after the sterilization was counted by cultivating for seven days at 30° C. on a potato dextrose agar medium and sterilization effect was calculated by Log(initial number of bacteria/number of surviving bacteria).

Relation between the sterilization effect and sterilizing temperature and time of the inner and outer surfaces of the bottle is shown in Table 2.

TABLE 2

| | time (seconds) 3 | 5 | 8 | 10 |
|---|---|---|---|---|
| Bottle inner surface temperature (° C.) | | | | |
| 63 | X | X | ○ | ○ |
| 65 | X | ○ | ○ | ◎ |
| 67 | ○ | ◎ | ◎ | ◎ |
| 69 | ◎ | ◎ | ◎ | ◎ |
| Bottle outer surface temperature (° C.) | | | | |
| 63 | X | X | ○ | ○ |
| 65 | X | ○ | ○ | ◎ |
| 67 | ○ | ◎ | ◎ | ◎ |
| 69 | ◎ | ◎ | ◎ | ◎ |

| Sterilizing effect | | |
|---|---|---|
| | 6 D or over | ◎ |
| | 3 D or over | ○ |
| | Below 3 D | X |

Example 3

*Aspergillus niger* ATCC6275 was cultivated on a potato dextrose agar medium for 30 days and this bacterium was used as a test bacterium.

Spore suspension of the test bacterium was deposited on a suitable place of the surface of the apparatus so that the suspension will be deposited at the rate of $10^6$ cfu/100 $cm^2$.

After drying, sterilization was made by circulating heated water.

The number of surviving bacteria on the surface of the apparatus after the sterilization was counted by cultivating for seven days at 30° C. on a potato dextrose agar medium and sterilization effect was calculated by Log(initial number of bacteria/number of surviving bacteria).

Relation between the sterilization effect and sterilizing temperature and time on the surface of the apparatus is shown in Table 3.

TABLE 3

| Sterilizing temperature (° C.) | time (minutes) 1 | 2 | 3 |
|---|---|---|---|
| 55 | X | X | X |
| 60 | ○ | ○ | ◎ |
| 65 | ◎ | ◎ | ◎ |

| Sterilizing effect | | |
|---|---|---|
| | 6 D or over | ◎ |
| | 3 D or over | ○ |
| | Below 3 D | X |

Example 4

Figure 7:
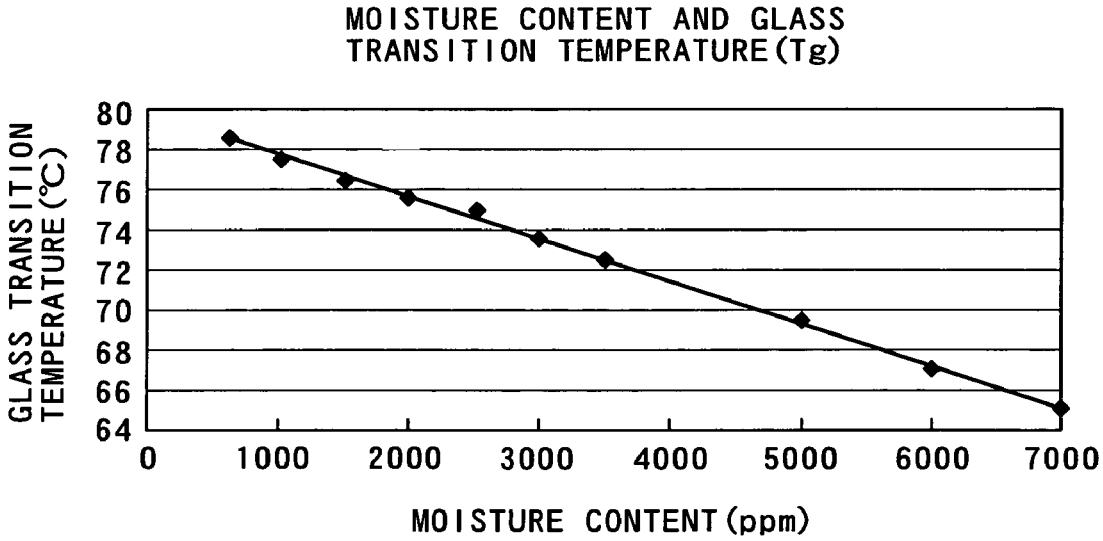
FIG. 7 is a graph showing relation between moisture content of a bottle and glass transition temperature of the bottle.

For examining heat resistance of a PET bottle with a non-crystallized neck portion, relation between moisture content of the non-crystallized neck portion (undrawn portion) and Tg (glass transition temperature) was calculated. Results are shown in FIG. 7. From FIG. 7, it will be understood that there is linear relationship between moisture content of the bottle and glass transition temperature of the bottle and the smaller moisture content, the higher is glass transition temperature.

Example 5

Figure 8:
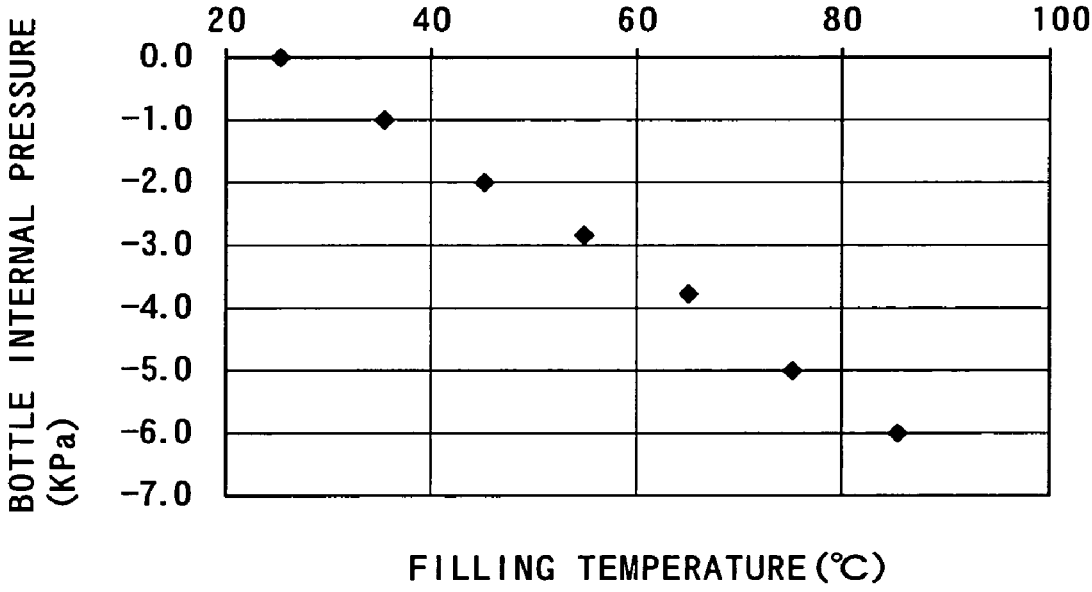
FIG. 8 is a graph showing relation between content filling temperature and internal pressure of the bottle.

For finding out state of reduction in the head space portion of a PET bottle with a non-crystallized neck portion by filling of contents liquid, relation between the filling temperature and the internal pressure of the bottle was examined by the manufacturing process shown in the flow chart of FIG. 1. Results are shown in FIG. 8. From FIG. 8, it will be understood that internal pressure from about −1.5 kPa to about −5 kPa is obtained.

This figure was obtained by using a PET bottle having a capacity of 500 ml and having a columnar reduced pressure absorbing panel with a capacity of head space during filling of 17 ml.

INDUSTRIAL UTILITY

The present invention can improve the production efficiency by applying the invention to production of contents filled in a polyester container, particularly to production of a beverage filled in a PET bottle.

The invention claimed is:

1. A method for producing contents filled in a container comprising steps of:

introducing a polyester container with a non-crystallized neck portion into a sterilized closed space having sterility and closed state on a commercial basis and comprising at least space in which a bottle sterilizing process is performed, space in which a filling process is performed and space in which a sealing process is performed, entire inner surface of said sterilized closed space and surface of an apparatus disposed in said sterilized closed space being sterilized by wet heating of the space using, medium consisting of heated water and/or water steam, at least the space in which the filling process is performed and the space in which the sealing process is performed being kept under a positive pressure by sterilized air;

heating and sterilizing the container at least in its inner surface by wet heating using hot water and/or water steam; and filling the contents in the sterilized container at a filling temperature within a temperature range from 40° C. to a temperature less than glass transition temperature which is determined by moisture content of the material of the non-crystallized neck portion in the container and then sealing the container, wherein the upper limit of the filling temperature is 80° C.

2. A method for producing contents filled in a container as defined in claim 1 wherein the space in the sterilized closed space in which the bottle sterilizing process is performed is held under a positive pressure by supplying sterilized air or introducing air under positive pressure in the adjacent filling process.

3. A method for producing contents filled in a container as defined in claim 1 wherein sterilization of the surface of the apparatus in the sterilized closed space is performed by wet heating sterilization in such a manner that surface temperature of the surface to be sterilized will become 60° C. or over and less than 96° C.

4. A method for producing contents filled in a container as defined in claim 3 wherein the container introduced into the sterilized closed space is introduced into the sterilized closed space after being subjected in the outer surface of the container to wet heating sterilization using heated water and/or water steam.

5. A method for producing contents filled in a container as defined in claim 4 wherein the process of sterilizing the outer surface of the container introduced into the sterilized closed space is performed by wet heating sterilization in such a manner that heated water and/or water steam is injected from a heated water injection nozzle or a steam injection nozzle onto the container so that temperature of the outer surface of the container will become 63° C. or over and less than 80° C.

6. A method for producing contents filled in a container as defined in claim 4 wherein the process of sterilizing the outer surface of the container introduced into the sterilized closed space is performed in an outer surface sterilizing chamber which communicates with the sterilized closed space and is provided with an entrance and an exit of the container.

7. A method for producing contents filled in a container as defined in claim 6 wherein the outer surface sterilizing chamber is filled with water steam.

8. A method for producing contents filled in a container as defined in claim 1 wherein the container introduced into the sterilized closed space is introduced into the sterilized closed space after being subjected in the outer surface of the container to wet heating sterilization using heated water and/or water steam.

9. A method for producing contents filled in a container as defined in claim 8 wherein the process of sterilizing the outer surface of the container introduced into the sterilized closed space is performed by wet heating sterilization in such a manner that heated water and/or water steam is injected from a heated water injection nozzle or a steam injection nozzle onto the container so that temperature of the outer surface of the container will become 63° C. or over and less than 80° C.

10. A method for producing contents filled in a container as defined in claim 8 wherein the process of sterilizing the outer surface of the container introduced into the sterilized closed space is performed in an outer surface sterilizing chamber which communicates with the sterilized closed space and is provided with an entrance and an exit of the container.

11. A method for producing contents filled in a container as defined in claim 10 wherein the outer surface sterilizing chamber is filled with water steam.

12. A method for producing contents filled in a container as defined in claim 1 wherein the process of sterilizing at least the inner surface of the container is performed by wet heating sterilization in such a manner that temperature of the inner surface of the container will become 63° C. or over and less than 96'C.

13. A method for producing contents filled in a container as defined in claim 1 which further comprises a process of reducing moisture content of the material of the container before filling the contents in the container.

14. A method for producing contents filled in a container as defined in claim 1 which further comprises a process of forming a preform of the container, a process of forming the preform to the container and a process of reducing moisture content of the preform before forming the preform to the container.

15. A method for producing contents filled in a container as defined in claim 1, wherein, after the container is formed, the formed container is transferred directly to the process of sterilizing at least the inner surface of the container in the sterilized closed space.

16. A method for producing contents filled in a container as defined in claim 15 wherein forming of the container is performed in an outer environment controlled space.

17. A method for producing contents filled in a container as defined in claim 16 wherein the outer environment controlled space is Class 100,000 or below.

18. A method for producing contents filled in a container as defined in claim 15 which further comprises a process of forming a preform of the container and a process of forming the preform to the container wherein the formed preform is directly transferred to the process of forming the preform to the container.

19. A method for producing contents filled in a container as defined in claim 18 wherein forming of the preform, transferring of the preform to the container forming process and forming of the container are performed in an outer environment controlled space.

20. A method for producing contents filled in a container as defined in claim 19 wherein the outer environment controlled space is Class 100,000 or below.

* * * * *